United States Patent [19]

Connelly

[11] Patent Number: 4,590,627

[45] Date of Patent: May 27, 1986

[54] CURVED GLOVE CONSTRUCTION UTILIZING ELASTICIZED THREADED SEAMS

[75] Inventor: John R. Connelly, Deerfield, Ill.

[73] Assignee: Marmon Company, Chicago, Ill.

[21] Appl. No.: 718,967

[22] Filed: Apr. 1, 1985

[51] Int. Cl.[4] ..... A41D 19/00

[52] U.S. Cl. ..... 2/163; 2/167; 2/161 A

[58] Field of Search ..... 2/163, 158, 159, 161 A, 2/167, 168

[56] References Cited

U.S. PATENT DOCUMENTS

| | | | |
|---|---|---|---|
| 2,700,770 | 2/1955 | Stanton | 2/163 X |
| 2,707,283 | 5/1955 | Silver et al. | 2/159 |
| 3,152,338 | 10/1964 | Strauss | 2/163 |
| 4,245,357 | 1/1981 | Connelly | 2/163 |
| 4,494,249 | 1/1985 | Hansson | 2/163 |

*Primary Examiner*—Ronald Feldbaum

*Attorney, Agent, or Firm*—Pennie & Edmonds

[57] ABSTRACT

A curved glove construction is disclosed wherein the fingers of the glove curve inwardly toward the palm portion of the glove to conform to the configuration of a hand when in a relaxed state. Each finger of the glove has at least one elasticized thread stitching on a palm side thereof to impart curvature to the fingers.

9 Claims, 5 Drawing Figures

CURVED GLOVE CONSTRUCTION UTILIZING ELASTICIZED THREADED SEAMS

TECHNICAL FIELD

The invention relates to a curved glove construction utilizing elasticized thread stitching to conform to the natural curved configuration of a hand when in a relaxed state and specifically such that the fingers of the glove in a relaxed state will be curved inwardly towards the palm.

BACKGROUND ART

Gunn-cut gloves have been cut in the past and the parts sewn together flat such that in the finished assembled state, the gloves have straight extending fingers. Such gloves however are not as comfortable to wear as fashioned gloves which follow the natural contour of the hand in a relaxed state. Gloves have been constructed in the past to follow the contour of the hand in the relaxed state but such gloves have been expensive to make. For example high fashion gloves utilizing separate fourchette portions between the front and back parts of the fingers have been utilized where the fourchettes are curved such that the resulting glove configuration will have curved fingers. The use of separate fourchettes necessarily increases the expense of manufacturing gloves and, because of their curved shape, require a high degree of operator skill in sewing the parts together.

Curved gloves have been made in the past by molding processes to give the glove a shape to conform generally with the natural contour of the hand when in a relaxed state. For example single piece rubber gloves have been molded but such molding procedures are not applicable for making cloth or leather gloves.

Further, curved gloves have been made wherein the back portion of each of the fingers is longer in length than its corresponding front or palm portion. In addition the palm piece of the glove extending between the thumb joint and the finger joints is shorter than the corresponding back piece to further enhance the curved effect of the glove.

Gloves have been made utilizing elasticized components. Elastic material has been employd to expand the size of the glove to accommodate hands of different sizes. These gloves are costly to manufacture in that the elastic components must be sewn to the leather or cloth part of the glove requiring a high degree of operator skill in sewing the parts together.

Gloves have been made utilizing elastic material which is stressed and stitched to the glove so that when the elastic contracts, it produces a gathered effect on the back of the glove, serving to prevent wrinkling of the palm side of the glove. However, the elastic does not cause the fingers of the glove to curve inwardly toward the palm portion of the glove to conform to the configuration of the hand when in a relaxed state.

It is therefore an object of the invention to provide for a glove construction which will have a curved configuration so as to conform to the curved shape of a hand when in the relaxed state and which at the same time may be manufactured economically without requiring a great deal of sewing skill.

GENERAL DESCRIPTION OF THE INVENTION

In the present invention I have devised a curved glove construction which conforms to the natural configuration of a human hand that is in a relaxed state. Unlike the prior art, my invention comprises a curved glove construction having at least one curved finger portion with at least one elasticized thread stitching extending along a part of the length of the finger portion and on the palm side thereof. In order to impart a curved configuration to the finger portions of the glove, the elasticized stitching is positioned near the side of a finger portion and on the palm side thereof with the ring finger and middle finger portions prefereably each having two said stitchings extending along a part of the length of the two opposite sides and on the palm side thereof.

DESCRIPTION OF THE PREFERRED EMBODIMENTS

Figure 1:
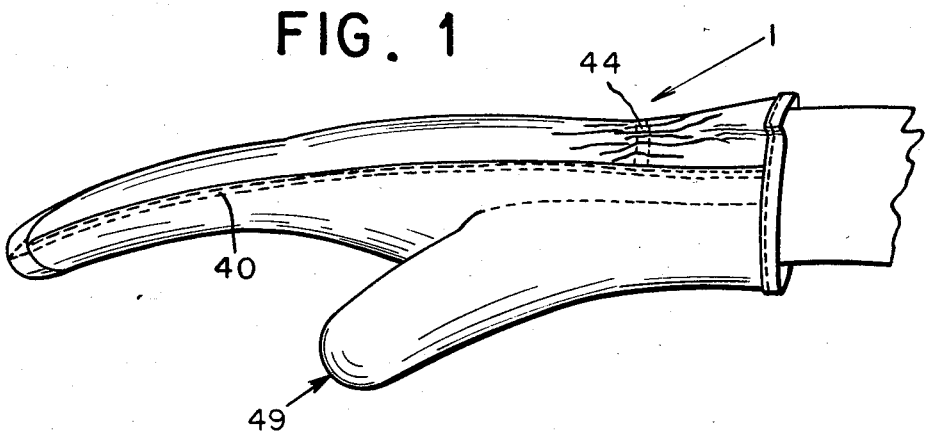
FIG. 1 is a side view of a glove constructed according to the invention having elasticized thread stitching utilized to impart curvature to the finger portions.

FIG. 1 shows the side of a Gunn-cut glove 1 constructed according to the invention having elasticized thread stitching utilized to impart curvature to the finger portions.

Figure 2:
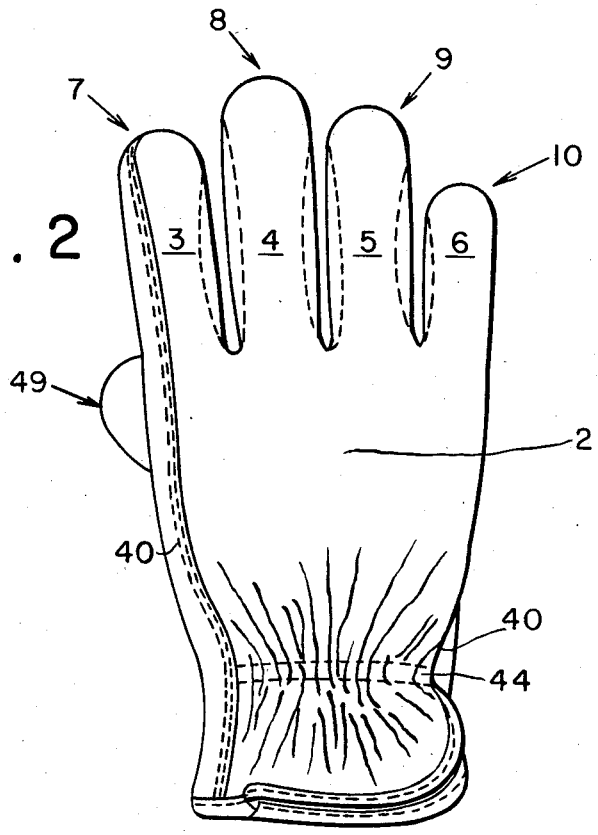
FIG. 2 is a plan view of the back side of the glove of FIG. 1.

FIG. 2 illustrates the back side of the glove construction of FIG. 1 comprising a back piece 2 including back elements 3–6 of the four finger portions 7–10 comprising index, middle, ring and little fingers respectively.

Figure 3:
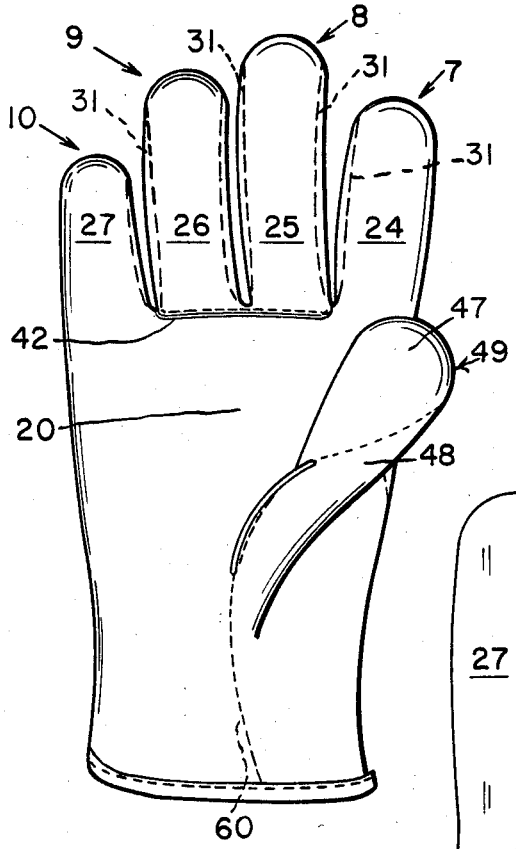
FIG. 3 is a plan view of the palm side of the glove of FIG. 1.
Figure 5:
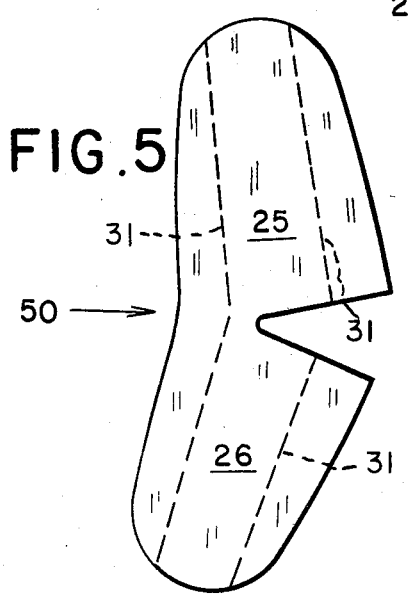
FIG. 5 is a plan view of a palm element of the middle and ring finger portions of the glove of FIG. 3 in the flat.

Referring to FIG. 3, the palm side of the glove 1 is shown comprising a palm piece 20 as well as palm elements 24–27 of the finger portions 7–10 respectively. The palm elements 24 and 27 are integral with the palm piece while the palm elements 25 and 26 form a single separate finger piece 50 as shown in FIG. 5.

The back side 2, palm piece 20 and finger piece 50 are all joined together by a conventional stitched seam 40 which extends longitudinally along one side of the glove to join the palm piece and back piece around the finger portion 7 to join palm element 24 and back element 3, around the finger portions 8 and 9 to join back elements 4 and 5 to finger elements 25 and 26, around the finger portion 10 to join palm element 27 to back element 6 and finally longitudinally along an opposite longitudinal side of the glove to join palm piece 20 and back piece 2. In addition, the lower end of palm elements 25 and 26 of the separate piece 50 are connected to the palm side 20 by a separate stitched seam 42. The resulting construction is a Gunn-cut glove.

The glove 1 may conveniently have an elastic strip 44 stitched on the back side thereof and extending between the seams 40 on either side of the glove to provide a tight fit around the wrist of the wearer of the glove.

Referring to FIG. 3 an elasticized thread stitching 31 is shown utilized to impart curvature to the finger portions 7–10 and is positioned near at least one longitudinally extending side of each finger portion. The ring finger 9 and middle finger 8 portions preferably each have two said stitchings extending along two opposite sides thereof. As is apparent from FIG. 3, the elasticized stitching when in the relaxed unstretched state will draw or curve the ends of the finger portions 7–10 in towards the palm of the glove so that the resulting configuration will conform to the curvature of a hand when in a relaxed state.

FIG. 3 also shows the palm element 47 and back element 48 of a thumb portion 49. Non-elastic threads 60 are utilized to sew the back element of the thumb 48 to the palm side 20 which includes the palm element of the index 24 and little 27 finger portions and the palm element of the thumb 47.

Figure 4:
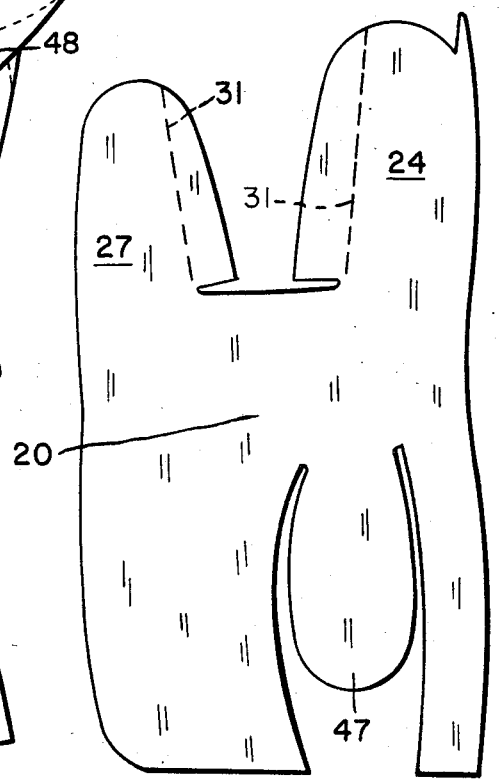
FIG. 4 is a plan view of a palm piece of the glove of FIG. 1 including a palm element of the index and little finger portions in the flat.

FIG. 4 shows the palm piece of the glove including the palm element of the index 24 and little 27 finger portions and the palm element of the thumb 47 as shown in FIG. 3 in the flat and before being joined to other glove parts.

The elasticized thread stitching 31 utilized to impart curvature to the finger portions of the glove is positioned preferably near the inner sides of the finger portions 24 and 27 and extends along at least a portion of the longitudinal length of these finger portions.

FIG. 5 shows the palm element of the middle and ring finger portions 25 and 26 of the glove in FIG. 3 in the flat and before joining with other parts of the glove with the elasticized stitching 31 extending along two opposite sides of the palm element of the middle and ring finger portions for at least a portion of the longitudinal length of the finger portions.

Preferably as shown in FIGS. 4 and 5, the elasticized stitching is added to the palm piece and separate piece 50 prior to their being joined to form the glove and while still in the flat. This simplifies sewing operation. Further sewing operations are made easier by the fact that the stitchings 31 are in straight lines rather than in difficut-to-follow curved lines.

Although I have illustrated my invention in terms of a Gunn-cut glove construction, the use of elasticized stitching to impart curvature to the finger portions is applicable for use in other forms of glove constructions including, for example, Clute-cut glove constructions. Further it is apparent that the elasticized stitching is applicable for use with gloves made of many different materials including leather, plastic or heavy fabric.

I claim:

1. A curved glove construction having at least one curved finger portion with back and palm sides, the improvement comprising in that said curved finger portion has at least one elasticized thread stitching extending along a part of the length of said finger portion and on only the palm side thereof.

2. A curved glove construction according to claim 1, the improvement further comprising in that said stitching is positioned near the side of a finger portion.

3. A curved glove construction according to claim 1 having four finger portions, the improvement further comprising in that each said finger portion has at least one said stitching extending along one side thereof.

4. A curved glove construction according to claim 3, the improvement further comprising in that ring finger and middle finger portions each have two said stitchings extending along two opposite sides thereof.

5. A curved glove construction according to claim 4, the improvement further comprising in that each said finger portion comprises a back element and a palm element and in that each said stitching is on a palm element.

6. A curved glove construction according to claim 5, the improvement further comprising in that said glove is in the form of a Gunn-cut glove wherein a back side of the glove includes the back elements of the four finger portions, a palm side includes a palm piece having palm elements of the index and little finger portions and where the palm elements of the middle and the ring finger portions are unitary.

7. A curved glove construction having finger portions each comprised of a back element and a palm element connected directly together by stitching, the improvement comprising in that the palm element of each finger portion has at least one elasticized thread stitching extending along at least at a part of the length and adjacent to the side thereof, each of said elasticized thread stitchings being stitched only to the palm element of each finger portion and in the relaxed unstretched state imparting a curved configuration to the finger portions.

8. A curved glove construction according to claim 7, the improvement further comprising in that the ring finger and middle finger portions each have said stitchings extending along and adjacent the opposite sides thereof.

9. A curved glove construction according to claim 8, the improvement further comprising in that the index and little finger portions have said stitching only along and adjacent the sides thereof facing the middle and ring finger portions, respectively.

* * * * *